US006152491A

United States Patent [19]

Queentry

[11] Patent Number: 6,152,491

[45] **Date of Patent: *Nov. 28, 2000**

[54] SKI POLE INCORPORATING SUCCESSIVE INTERMITTENT FLASHING AND HIGH-INTENSITY LIGHTING ASSEMBLIES

[76] Inventor: Dominic Queentry, 26790 Linwood, Roseville, Mich. 48066

[ * ] Notice: This patent issued on a continued prosecution application filed under 37 CFR 1.53(d), and is subject to the twenty year patent term provisions of 35 U.S.C. 154(a)(2).

[21] Appl. No.: 09/059,512

[22] Filed: Apr. 13, 1998

[51] Int. Cl.[7] ..... A63C 11/22

[52] U.S. Cl. ..... 280/819; 362/102; 362/800

[58] Field of Search ..... 280/819, 821, 280/809; 135/66, 910, 65; 362/102, 109, 157, 184, 249, 800

[56] References Cited

U.S. PATENT DOCUMENTS

| | | | |
|---|---|---|---|
| 3,798,631 | 3/1974 | Langford . | |
| 4,023,817 | 5/1977 | Lah et al. . | |
| 4,066,889 | 1/1978 | Hodgson . | |
| 4,111,444 | 9/1978 | Clements, Jr. . | |
| 4,129,311 | 12/1978 | Hodgson et al. . | |
| 4,148,096 | 4/1979 | Haas et al. | 362/102 |
| 4,206,445 | 6/1980 | Steinhauer | 280/819 |
| 4,231,079 | 10/1980 | Heminover | 362/184 X |
| 4,236,544 | 12/1980 | Osaka | 135/66 |
| 4,254,451 | 3/1981 | Cochran, Jr. | 362/800 |
| 4,279,433 | 7/1981 | Petaja . | |
| 4,625,742 | 12/1986 | Phillips | 135/66 |
| 4,848,009 | 7/1989 | Rodgers . | |
| 4,967,684 | 11/1990 | Vidovic et al. | 280/821 |
| 5,024,866 | 6/1991 | Goode . | |
| 5,033,212 | 7/1991 | Evanyk . | |
| 5,036,442 | 7/1991 | Brown | 362/102 |
| 5,056,821 | 10/1991 | Fierro . | |
| 5,081,568 | 1/1992 | Dong | 362/184 |
| 5,149,489 | 9/1992 | Crews . | |
| 5,265,911 | 11/1993 | Goode . | |
| 5,271,640 | 12/1993 | Potochick et al. . | |
| 5,294,151 | 3/1994 | Goode . | |
| 5,313,187 | 5/1994 | Choi et al. | 362/800 X |
| 5,327,329 | 7/1994 | Stiles | 280/809 |
| 5,420,768 | 5/1995 | Kennedy | 362/109 X |
| 5,458,372 | 10/1995 | Goode . | |
| 5,471,373 | 11/1995 | Coleman et al. | 362/109 |
| 5,502,624 | 3/1996 | Tu | 362/102 |
| 5,503,432 | 4/1996 | Goode . | |
| 5,506,760 | 4/1996 | Giebler et al. | 362/249 |
| 5,588,735 | 12/1996 | Harada | 362/102 |
| 5,604,999 | 2/1997 | Barker . | |
| 5,607,226 | 3/1997 | Toth et al. | 362/102 X |
| 5,622,423 | 4/1997 | Lee | 362/102 X |
| 5,653,529 | 8/1997 | Spocharski | 362/184 |
| 5,697,695 | 12/1997 | Lin et al. | 362/102 X |
| 5,707,135 | 1/1998 | Miller, Jr. | 362/102 |
| 5,738,433 | 4/1998 | Sparks | 362/109 |
| 5,743,621 | 4/1998 | Mantha | 362/184 X |
| 5,848,831 | 12/1998 | Tatsumi | 362/102 |
| 5,865,202 | 2/1999 | Murphy | 362/102 X |
| 5,865,524 | 2/1999 | Campman | 362/102 |
| 5,871,271 | 2/1999 | Chien | 362/800 X |
| 5,890,794 | 4/1999 | Abtahi et al. | 362/184 X |

*Primary Examiner*—Lanna Mai
*Assistant Examiner*—Ruth Ilan
*Attorney, Agent, or Firm*—Gifford, Krass, Groh, Sprinkle, Anderson & Citkowski, P.C.

[57] ABSTRACT

A ski pole incorporating a intermittent flashing and high intensity lighting assemblies. The ski pole includes an elongate and substantially cylindrical shaft which terminates at a first end in a hand grip and at a second end in a spike engaging portion. First through sixth individual lighting elements are located at longitudinally spaced apart and circumferentially arrayed locations of the ski pole shaft. The lighting elements each include light emitting diodes which are connected in parallel to a microprocessor, the microprocessor being capable of instructing each of the lighting elements to illuminate successively for a selected period of time. A battery source is incorporated into the ski pole and is capable of powering the microprocessor and individual lighting elements. An on/off switch is located in proximity to the hand grip and is capable of activating/deactivating the microprocessor and lighting elements.

5 Claims, 2 Drawing Sheets

SKI POLE INCORPORATING SUCCESSIVE INTERMITTENT FLASHING AND HIGH-INTENSITY LIGHTING ASSEMBLIES

BACKGROUND OF THE INVENTION

1. Field of the Invention

The present invention relates generally to lighted ski pole assemblies and, more particularly, to a ski pole construction incorporating successive intermittent flashing and high-intensity lighting assemblies.

2. Description of the Prior Art

The prior art is well documented with ski pole assemblies which provide some degree of illumination, the purpose for which is to assist skiers in identifying one another during nighttime skiing as well as providing a locating beacon for a downed or injured skier. An example of such an illuminating ski pole is described in U.S. Pat. No. 5,056,821, issued to Fierro, which teaches a pole with a light dispensing shaft and a light dispensing fiber optic element affixed to its shaft. The light dispensing element is most typically a light bulb mounted in an upper location of the pole shaft interior and issuing light beams which are bounced and illuminated through the transparent or translucent construction of the shaft.

Numerous additional examples of lighted ski pole designs are illustrated in U.S. Pat. No. 4,023,817, issued to Lah et al., U.S. Pat. No. 5,271,640 issued to Potochick et al., U.S. Pat. Nos. 4,066,889 and 4,129,311, both issued to Hodgson, U.S. Pat. No. 4,279,433, issued to Petaja, and U.S. Pat. No. 5,149,489 issued to Crews. The Lah et al. '817 patent teaches a ski pole again with a transparent/translucent tubular wall for emanating light produced by a light bulb. Potochick '640 discloses a further such design with an interchangeable translucent plastic tubular body. Hodgson '889 further teaches the provision of an inclined mirror element arrayed within the hollow interior of the ski pole. Light impinging upon the mirror from a light bulb mounted from above is directed radially outwardly through a lens member fitted into the wall of the ski pole so that the reflected light is projected outwardly to illuminate the surrounding terrain.

Hodgson '311 teaches a cylindrical chemiluminescent member having an enlarged head portion disposed within the hollow interior of the ski pole shaft which is acted upon by a spring member to emanate light through an appropriate opening in the wall of the body. Petaja '433 discloses, in part, an intermittently flashing lamp in the ski pole, see FIG. 6, such pole incorporating a light-sensitive device such as a photocell for illuminating through a window in the pole. Finally, the Crews '489 patent teaches illuminating ski boots and poles in which the translucent middle portions of the poles include flashing light bulb, lens and optical fiber elements.

A further teaching for increasing the visibility of an object is disclosed in U.S. Pat. No. 5,033,212, issued to Evanyk, which discloses high-intensity LEDS's mounted on or forming part of an object to be illuminated, in this instance an athletic shoe. An electrical circuit is operatively connected to the LED elements and is contained within a package that is attached to the shoe through the use of Velcro straps.

SUMMARY OF THE PRESENT INVENTION

The present invention is a ski pole design which incorporates a plurality of successive and, preferably intermittent, flashing lighting high-intensity lighting assemblies, such as LED elements. The ski pole includes an elongate and substantially cylindrical shaft terminating at a first end in a hand grip and at a second end in a spike engaging portion.

The lighting assemblies further include a plurality of individual lighting elements, again preferably being LED elements which are selected for their durability, high level of illumination, and long life. The individual lighting elements are located at longitudinally spaced apart locations along the shaft of the ski pole and at selected circumferential locations.

A microprocessor is secured within the interior of the ski pole and is operably connected in parallel to each of the plurality of individual lighting elements and is capable of instructing each of the lighting elements to illuminate for selected periods of time. A battery source is also incorporated into the ski pole and is capable of powering the microprocessor and individual lighting elements. An on/off switch is located in proximity to the hand grip and is capable of activating/deactivating the microprocessor and lighting elements.

In the preferred embodiment, the lighting assemblies are provided by first, second, third, fourth, fifth and sixth LED elements which are arrayed at longitudinally and equidistantly spaced locations and at sixty degree incremental circumferential offset around an entire 360 degree arc and so that, in use, the flashing LEDs are clearly visible at any location around the skier. In a preferred use, the LED elements flash in progressive sequence for fractions of a second each and, owing again to their high level of illumination, are visible to others in any weather or lighting conditions, even daytime, to distances of up to 500 meters. Accordingly, the ski pole with lighting assemblies according to the present invention is a significant advance over the prior art ski pole lighting assemblies which are all, for the most part, rather more limited in their durability, degree of luminescense and active life.

BRIEF DESCRIPTION OF THE DRAWINGS

Reference will now be made to the attached drawings, when read on combination with the following specification, wherein like reference numerals refer to like parts throughout the several views, and in which.

DETAILED DESCRIPTION OF THE PREFERRED EMBODIMENTS

Figure 1:
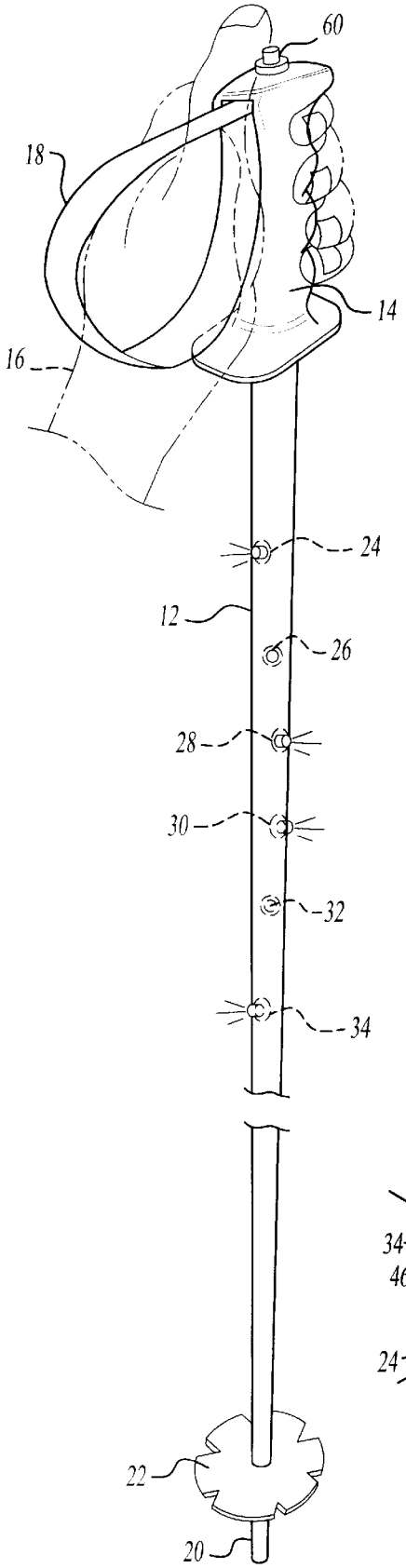
FIG. 1 is a perspective of a ski pole incorporating successive intermittent flashing and high-intensity lighting assemblies according to the preferred embodiment of the present invention.

Referring now to FIG. 1, a ski pole incorporating high-intensity lighting assemblies is illustrated at 10 according to the preferred embodiment of the present invention. The ski pole preferably includes an internally hollowed, elongate and substantially cylindrical shaft 12 which is constructed of a strong, lightweight and resilient aluminum composite as is desirous in the art. The shaft 12 terminates at a first upper end in a hand grip 14, such grip 14 being appropriately contoured as is known in the art so that it is suitable for gripping by a hand 16 of a user. A looped portion 18 may also be provided for looping around the wrist of the user's arm and for preventing the losing of the ski pole in the event the hand 16 becomes separated from the grip 14. Finally, the shaft 12 terminates at a second lower end in a spike engaging portion 20 for engaging the snow as the skier moves down a hill. As is also known in the relevant ski pole art, a cross sectionally mounted disc portion 22 is secured proximate the lower end of the ski pole shaft 12 and in relation to the spike engaging portion 20 so that only a limited amount of travel of the spike 20 into the surface of the snow layer is permitted.

Figure 2:
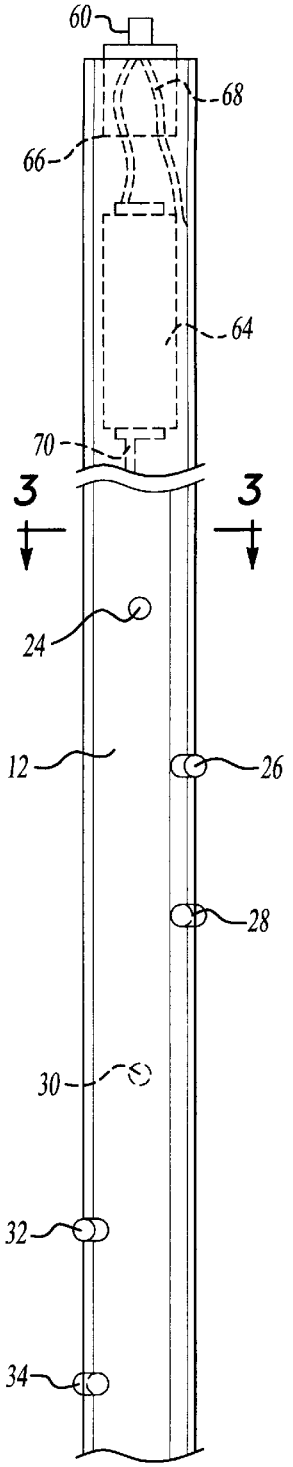
FIG. 2 is a sectional view of the ski pole shaft in cutaway and illustrating, in partial phantom, the on/off switch and batteries for powering the lighting assemblies according to the present invention.
Figure 3:
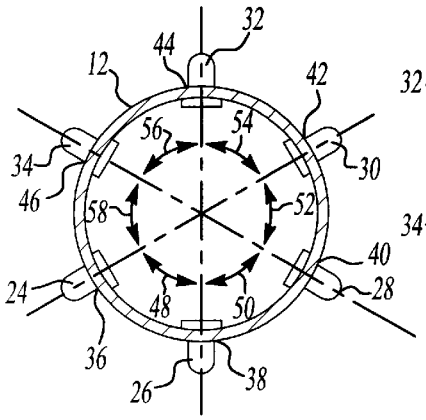
FIG. 3 is a cutaway view taken along line 3—3 of FIG. 2 and illustrating, in cross section, the angular incremental offset of the lighting assemblies in a surrounding circumferential display according to the preferred embodiment of the present invention.

Referring again to FIG. 1, and also to FIGS. 2 and 3, a plurality of six individual lighting elements are illustrated according to the preferred embodiment of the present invention. These include a first lighting element 24, a second lighting element 26, a third lighting element 28, a fourth lighting element 30, a fifth lighting element 32 and a sixth lighting element 34. As is clearly evident from FIGS. 1 and 2, the lighting elements are spaced in equidistant and longitudinal fashion along the length of the ski pole shaft 12, particularly the central region of the shaft 12 as is best viewed from FIG. 1. A series of apertures are formed into the ski pole 12 for reception of the lighting elements and include a first aperture 36, a second aperture 38, a third aperture 40, a fourth aperture 42, a fifth aperture 44 and a sixth aperture 46 for receiving the lighting elements 24, 26, 28, 30, 32 and 34, respectively (see FIG. 3).

As is further viewed again from FIGS. 1 and 2, and best of which from FIG. 3, the lighting elements 24, 26, 28, 30, 32 and 34 are further angularly offset in equal and incremental fashion around the circumference of the ski pole shaft 12 concurrent with their equidistant longitudinal spacing. Particularly, again referring to FIG. 3, the lighting elements are arrayed at 60 degree angular offset relative to one another, specifically at angle 48 between lighting elements 24 and 26, at angle 50 between lighting elements 26 and 28, at angle 52 between lighting elements 28 and 30, at angle 54 between lighting elements 30 and 32, at angle 56 between lighting elements 32 and 34 and, finally, at angle 58 between lighting elements 34 and 24. As was previously described in the summary of the present application, the purpose for the equidistant longitudinal spacing combined with the equiangular circumferential array is to provide illuminating warning to individuals at all locations around the user in a more effective fashion than that accomplished by any of the prior art.

Referring again to FIG. 1, an on/off switch 60 is located in the form of a push button mounted to a top surface of the hand grip 14. Referring further to FIG. 2, the on/off switch 60 is again illustrated in connection with phantom referenced elements proximately located at an upper end of the hollowed interior of the shaft 12. These elements include a portable power or battery source 64 (representatively illustrated) and connected at a first end by lead line 66 the switch 60. A further lead line 68 extends from the switch 60 to a microprocessing element (to be subsequently described). A second end of the battery source 64 is evidenced by a further lead line 70 representative of the enabling connection to the several lighting elements.

Figure 4:
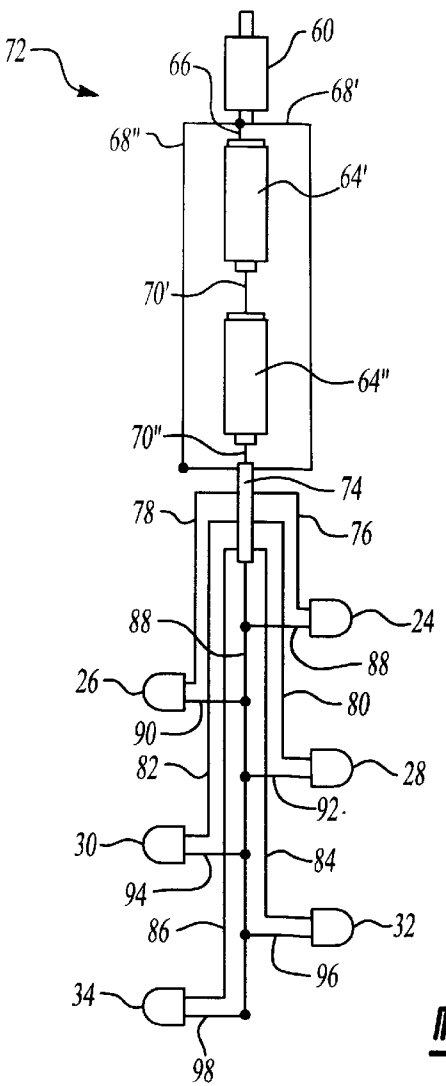
FIG. 4 is an electrical schematic illustrating the arrangement of components which in combination provide the lighting assemblies for incorporation into the ski pole according to the preferred embodiment of the present invention.

Referring now to FIG. 4, an operative electrical schematic is illustrated at 72 of the arrangement of components which make up the lighting assemblies of ski pole according to the present invention. Elements consistent with the illustrations of FIGS. 1–3 are represented herein and include the on/off switch 60 connected by lead line 66 to first 64' and second 64" series connected alkaline batteries, preferably AA batteries, which comprise the portable power source previously referenced at 64 in FIG. 2. The further lead line 68 of FIG. 2 is illustrated in the present schematic as lead lines 68' and 68" and which extend from the switch 60 to a chip mounted microprocessor board 74. Likewise, the battery lead line 70 of FIG. 2 is represented herein as a first lead line 70' extending from the first battery 64' to the second battery 64" and a second lead line 70" extending from the second battery 64" to the microprocessor 74.

The microprocessor 74 is preferably a 6035 chip mounted board and is operably connected in parallel to each of the six lighting elements. Specifically, a first lead line 76 extending from the microprocessor 74 connects to the first lighting element 24, a second lead line 78 connects to the second lighting element 26, a third lead line 80 connects to the third lighting element 28, a fourth lead line 82 connects to the fourth lighting element 30, a fifth lead line 84 connects to the fifth lighting element 32 and a sixth lead line 86 connects to the sixth lighting element 34. A common bus line 88 is also provided extending from the microprocessor 74 and each of the lighting elements 24, 26, 28, 30, 32 and 34 are separately connected to this common line 88, at additional lines 88, 90, 92, 94, 96 and 98 for first through sixth lighting elements 24, 26, 28, 30, 32 and 34, and preferably so as to function as a ground line.

Figure 5:
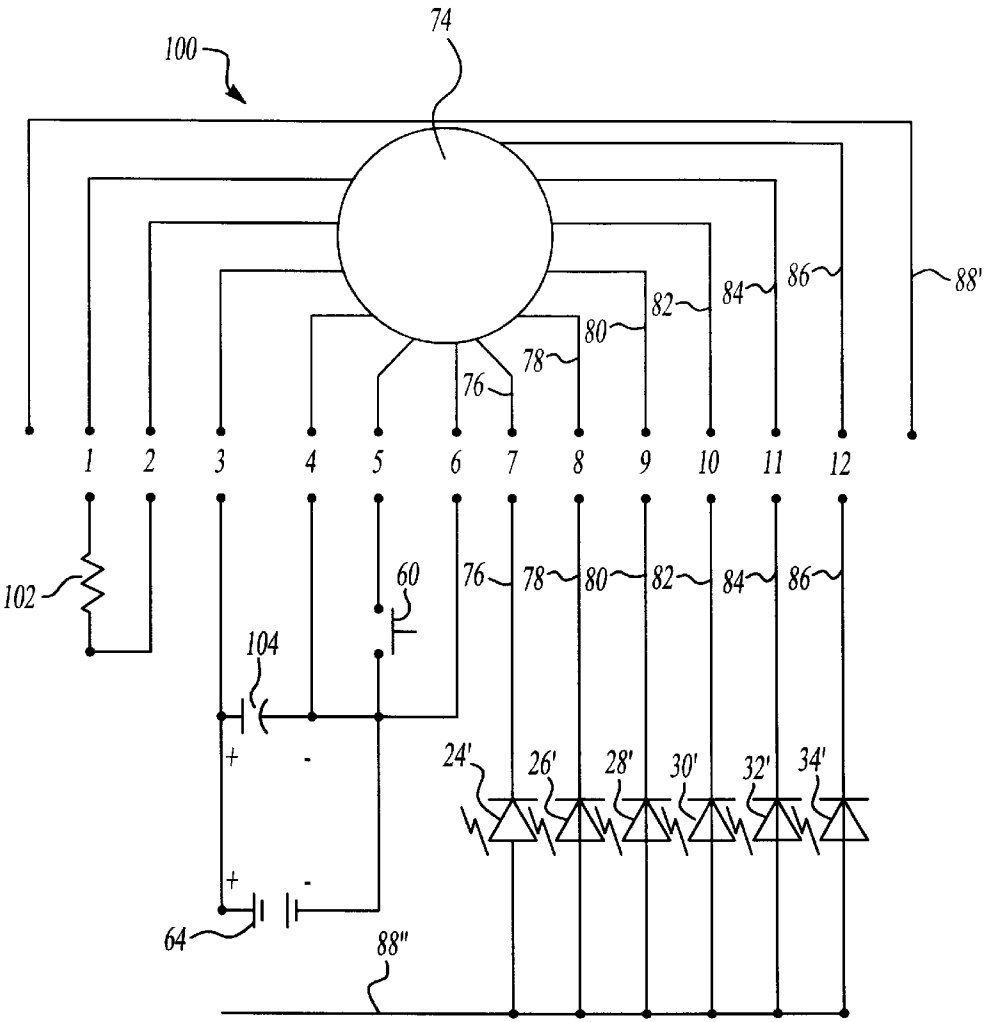
FIG. 5 is a further electrical schematic illustrating the operative connection between the microprocessor and the various circuitry elements illustrated in the schematic of FIG. 4, namely the diode lighting elements, on/off switch, power supply, capacitor and resistor according to the preferred embodiment of the present invention.

A further electrical schematic is illustrated at 100 upon reference to FIG. 5 and focuses on the perspective of the microprocessor 74 operably engaging the lighting elements in a desired arrangement. The lighting elements according to this figure illustration are presented as a series of light emitting diode (LED) lighting elements and these are presented as first lighting element 24', second lighting element 26', third lighting element 28', fourth lighting element 30', fifth lighting element 32' and sixth lighting element 34', all corresponding to the lighting elements 24, 26, 28, 30, 32 and 34 generally represented in the previous drawing illustrations. The LED elements 24', 26', 28', 30', 32' and 34' are further selected from a group of colors including purple, green, orange, and red.

A resistor 102 is connected in series between first and second nodes of the microprocessor 74 and acts to ground heat generated by operation of the microprocessor 74. In a preferred embodiment, the resistor 102 is rated at 120 kilo-ohms at ¼ watts. An electrolytic capacitor 104 is located between third and fourth nodes and, again preferably, is rated at 2.2 micro-farads at 50 volts DC (direct current). The on/off switch 60 is again represented schematically between fifth and sixth nodes, as is the power/battery source 64 which is operatively communicated with both the switch and capacitor so that, upon instruction from the microprocessor, the appropriate LED element is illuminated. The lead lines extending from the microprocessor 74 to the respective LED elements are again represented at 76, 78, 80, 82, 84 and 86 and which correspond with the seventh, eight, ninth, tenth, eleventh and twelfth nodes of the microprocessor 74 respectively. The common bus line established between the microprocessor 74 and LED elements is likewise schematically illustrated at 88' and 88".

In operation, the microprocessor 74 is programmed so that the switch 60, capacitor 104 and power supply 64 cause a stream of signals to be sent to the LED elements and to light the elements in a desired fashion. A preferred embodiment contemplates the microprocessor 74 lighting the first, second, third, fourth, fifth and sixth LED's for fractions of a second each and in a quick sequential fashion. It is also contemplated that the microprocessor could be programmed for illuminating the LED elements all at once in a steady or flashing manner or further that the LED elements could be illuminated in a totally random manner.

The advantages of the high-intensity lighting assemblies for use in a ski pole of the present invention include the rugged construction of the elements which will stand up to the impact forces normally generated in the normal use of a ski pole. This is in contrast to the more fragile nature of the conventional bulbs which are incorporated in many of the prior art lighted ski pole assemblies. Additional advantages include the relatively light weight, preferably no more than an additional 100 grams, which are added to the ski pole construction as well as the extremely long life of the batteries which is documented to be over 400 hours. Additionally, the high degree of illumination provided by the flashing LED elements is much more capable of being discerned by others at much further distances (up to 500 meters) than that of the prior art lighted ski poles.

Having described my invention, additional embodiments will become apparent to those skilled in the art to which it pertains without deviating from the scope of the appended claims.

I claim:

1. A ski pole incorporating successive intermittent flashing and high-intensity lighting assemblies, the ski pole including an elongate and substantially cylindrical shaft terminating at a first end in a hand grip and at a second end in a spike engaging portion, said lighting assemblies comprising:

a plurality of first, second, third, fourth, fifth and sixth individual and light emitting diode elements located at equidistant longitudinally spaced apart locations and at likewise equidistant circumferentially extending locations along the cylindrical shaft of the ski pole;

a microprocessor operable connected in parallel to each of said plurality of individual lighting elements and capable of instructing each of said lighting elements to illuminate for a selected period of time, said microprocessor further comprising a 6035 chip-mounted board, a resistor and a capacitor;

a battery source incorporated into the ski pole and capable of powering said microprocessor and said individual lighting elements, said battery source comprising a pair of AA alkaline batteries; and an on/off switch located in proximity to the hand grip and capable of activating/deactivating said microprocessor and said lighting elements, said on/off switch further comprising a push button located upon a top surface of the hand grip.

2. The ski pole with intermittent and high-intensity lighting assemblies as described in claim 1, said first, second, third, fourth, fifth and sixth lighting elements being arrayed at sixty degree angular increments around said circumference of the ski pole.

3. The ski pole with intermittent and high-intensity lighting assemblies as described in claim 1, said first, second, third, fourth, fifth and sixth lighting elements being selected from a group of colors including purple, green, orange, and red.

4. The ski pole with intermittent and high-intensity lighting assemblies as described in claim 1, said ski pole further being constructed of a strong and lightweight aluminum composite.

5. The ski pole with intermittent and high-intensity lighting assemblies as described in claim 4, the cylindrical shaft of the ski pole further comprising a first aperture, a second aperture, a third aperture, a fourth aperture, a fifth aperture and a sixth aperture for receiving, respectively, said first, second, third, fourth, fifth and sixth lighting elements.

* * * * *